US008187677B2

(12) United States Patent
Roumonis

(10) Patent No.: US 8,187,677 B2
(45) Date of Patent: May 29, 2012

(54) METHOD OF SILVER PLATING AND ARTICLES AND/OR OBJECTS FORMED BY THE METHOD OF SILVER PLATING

(76) Inventor: Demitrios Roumonis, Montreal (CA)

( * ) Notice: Subject to any disclaimer, the term of this patent is extended or adjusted under 35 U.S.C. 154(b) by 384 days.

(21) Appl. No.: 12/428,984

(22) Filed: Apr. 23, 2009

(65) Prior Publication Data

US 2010/0273009 A1 Oct. 28, 2010

(51) Int. Cl.
*B05D 3/08* (2006.01)
*B05D 7/00* (2006.01)

(52) U.S. Cl. ..... 427/419.1; 427/331

(58) Field of Classification Search ..... 427/419.1, 427/331; 428/425.9

See application file for complete search history.

(56) References Cited

U.S. PATENT DOCUMENTS 6,866,896 B2 * 3/2005 Heimann et al. ..... 427/397.8
2001/0012563 A1 * 8/2001 Sakai ..... 428/412

FOREIGN PATENT DOCUMENTS

JP 2001164380 A * 6/2001

* cited by examiner

*Primary Examiner* — Thao T. Tran
(74) *Attorney, Agent, or Firm* — Fay Sharpe LLP

(57) ABSTRACT

A process for electroless silver plating of a work piece includes simultaneously spraying a silver nitrate solution and a reducer on a work piece to form a reflective layer on the work piece, applying a water-based urethane coating on the reflective layer, and applying either a top coat that is solvent based or a powder based on the water-based urethane coating.

8 Claims, 2 Drawing Sheets

METHOD OF SILVER PLATING AND ARTICLES AND/OR OBJECTS FORMED BY THE METHOD OF SILVER PLATING

BACKGROUND

A known method of applying a chrome-like finish for a spray-on electroless plating system first applies a base coat to a work piece. An example of a base coat for the known system is a two-component urethane coating such as Cosmichrome™ Basecoat available from Cosmichrome, Inc. of Brossard, Quebec, Canada. Another base coat which may be used is formulated using an alkyd resin, and is also sold by Cosmichrome, Inc. The base coat is then dried and sprayed with a stannous chloride solution. The work piece is then rinsed with distilled or de-ionized water. Silver nitrate solution and reducer are then simultaneously sprayed onto the work piece. The work piece is then rinsed with distilled or de-ionized water. The work piece is then dried. Finally, it is known to apply a solvent-based top coat over the reflective finish that has been applied to the work piece. What is meant by "solvent-based" is that the solvent of the top coating is an organic based solvent that is not water.

This known electroless silver plating method can provide very nice results; however, the range of temperatures that the finished work piece can sustain and the durability of the reflective coating on the work piece can be improved. Moreover, it has been found that the solvent-based top coat can be removed and the top coat can sometimes remove the reflective layer from the base coat when scratched or removed from the work piece.

BRIEF DESCRIPTION

A process for electroless silver plating of a work piece that overcomes the aforementioned shortcomings includes simultaneously spraying a silver nitrate solution and a reducer on a work piece to form a reflective layer on the work piece, applying a water-based urethane coating on the reflective layer, and applying either a solvent-based top coat or a powder coat on the water-based urethane coating.

DETAILED DESCRIPTION

The present disclosure is directed to method of applying a thin reflective, metal layer on a substrate surface of a work piece. The present method is more specifically applicable to electroless plating, which is also known as chemical plating and auto-catalytic plating. The present method allows for application of a thin reflective, metal layer on non-metallic substrates. The present disclosure is generally directed to a method of electroless silver plating. Generally, electroless plating forces a reaction between a reductant and a substrate surface, wherein the former reductant donates electrons to the latter substrate surface to make it negatively charged.

Figure 1:
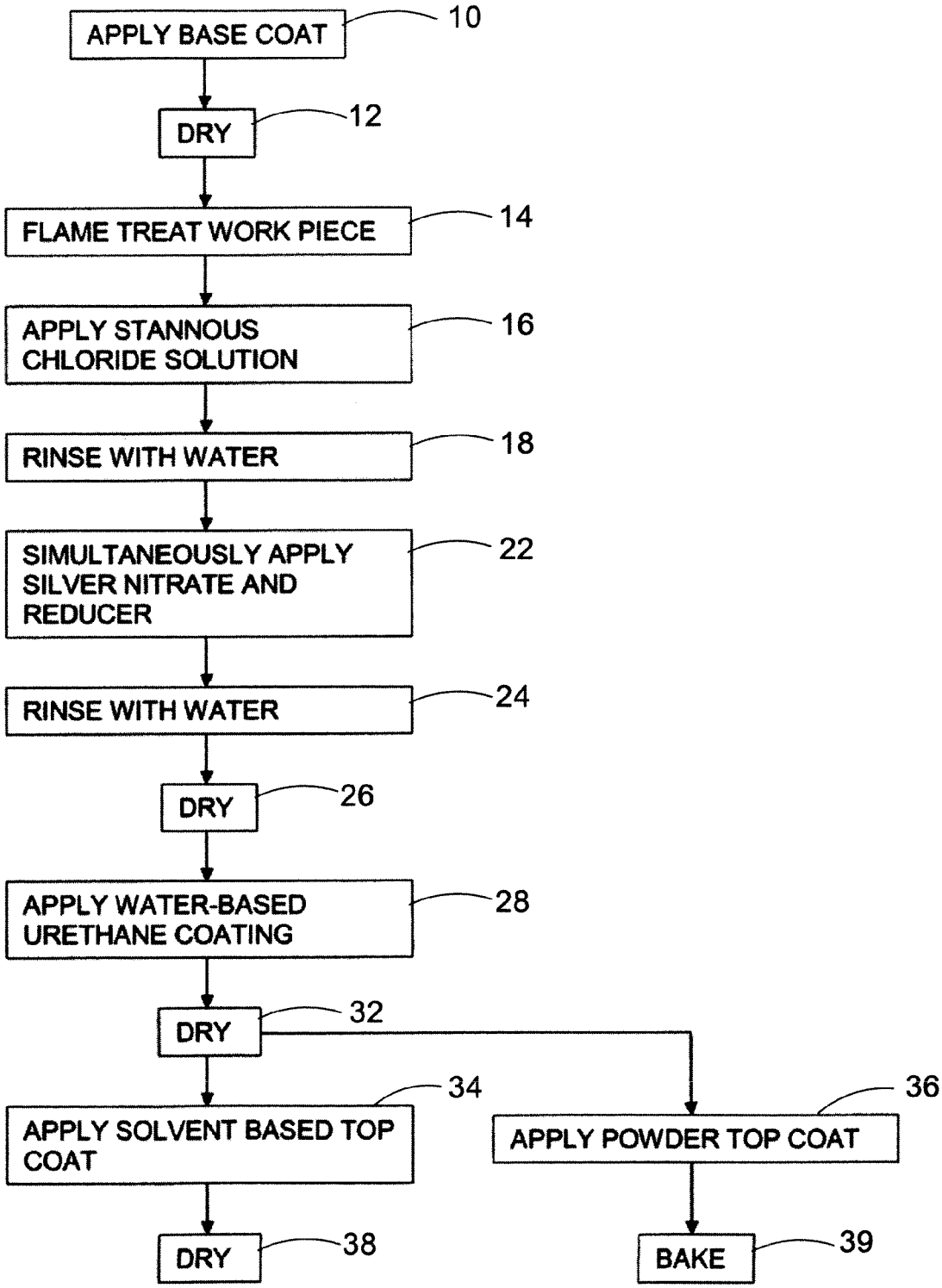
FIG. 1 is a flowchart showing a process for electroless silver plating of a work piece.

FIG. 1 is a diagram illustrating a process of utilizing a dual nozzle spray gun apparatus and system, such as the one disclosed in U.S. Patent Application Publication No. US 2007/0267523 (fully incorporated herein by reference) to apply silver nitrate solution and a reducer simultaneously on a work piece resulting in a very thin, highly reflective silver layer on the work piece. The method, however, is not limited to only application using the aforementioned dual nozzle spray gun. Other spraying apparatuses that can simultaneously spray silver nitrate solution and reducer onto a work piece can also be utilized with the process that will be described in more detail below.

Although the method illustrated in FIG. 1 is described below in the form of a series of acts or events, it will be appreciated that the various methods or processes of the present disclosure are not limited by the illustrated ordering of such acts or events. In this regard, some acts or events may occur in a different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated methods and other methods of the disclosure may be implemented in systems, in order to provide the control functionality described herein, and may be employed in any apparatus including, but not limited to, the aforementioned dual nozzle spray gun. Paache Airbrush Company of Lindenhurst, Ill. and Walther Pilot North America of Chesterfield, Mich. also sell a spray apparatus that can be used with the method described herein.

At 10, a base coat is applied to a work piece, where the work piece can have no existing coating over its exterior or exposed surface. The work piece can be made from any variety of materials, including but not limited to, plastics, ceramics, metals, wood and the like. An example of an appropriate base coat is Cosmichrome™ Basecoat available from Cosmichrome, Inc. of Brossard, Quebec, Canada. Other commercially available base coats can also be used, such as a base coat (Basecoat 812) available from Spectra Chrome LLC of Clearwater, Fla., and primer/adhesion promoters available from Jema American of Middlesex, N.J. Additionally, UV cured base coats, such as Jema-Cure UV base coat available from Jema American can also be used. In one embodiment the base coat is a two-component (catalyzed) base coat including a urethane resin. In another embodiment the base coat is an alkyd resin base coat. The two-component base coat and/or alkyd resin base coat can further include an additive for a later described flame treatment step. In one embodiment the additive is silicone.

The work piece is next dried at 12 once the base coat has been applied to the desired surface on the work piece. The drying step can be accomplished by any of a combination of several methods. A first method of drying the base coat can be by heating. The step of drying can similarly be accomplished by air drying, in which the work piece is exposed to ambient air for a duration of time which successfully dries the base coat.

It is desired that the base coating applied to the work piece coalesce to form a continuous film. This film can fail if the step of air drying 12 is achieved at too high e.g., 350° F. (177° C.) or too low e.g., 60° F. (16° C.) temperatures. For example, blisters can result if hot air drying is conducted at too high temperatures, and cracks and/or a non-continuous film can result from air drying and too low temperatures. Generally, cold drying temperatures result in very slow drying.

In one embodiment, after the base coat has dried to form a continuous film layer over the substrate surface, the base coat, with an additive such as silicone, is flame treated, which is also referred to as a plasma treatment or a corona treatment. This flame treatment promotes adhesion of the later applied silver to the base coat. The flame treatment, in one embodiment, is performed by passing a flame over the work piece that has been sprayed with the base coat. The flame treatment alters the surface tension of the treated surface so that the treated surface readily accepts paints or other coatings, including the later described silver coating.

The flame treatment 14 is followed by an application of a penetrating solution such as but not limited to stannous chloride at step 18. The stannous chloride solution, which is known in the electroless plating arts, penetrates the base coat. The stannous chloride also promotes adhesion of the silver to the base coat.

At 18, the work piece is rinsed with a rinsing agent. In one embodiment, the rinsing agent is a de-ionized or distilled water. Spraying the base-coated substrate of the work piece with clean water removes stannous chloride residues from the base coat and avoids contamination of the next step.

After the substrate is rinsed with the rinsing agent, the reflective silver layer is applied to the work piece at 22. Application of the reflective silver layer in the present method includes simultaneously spraying a silver nitrate solution and a reducer on the work piece to form a reflective layer on the work piece. A commercially available silver nitrate solution and reducer solution, both available from Cosmichrome, Inc. of Brossard, Quebec, Canada, is used in at least one embodiment.

In one embodiment of the disclosed process, the two solutions, the silver nitrate solution and the reducer, are simultaneously applied at approximately equal parts. Facilitating the desired equal part application can be accomplished using the aforementioned dual nozzle spray gun or another application system. It is desirable that the system for simultaneously applying the silver nitrate and reducer to the work piece be such a system where equal parts of each liquid mix downstream from respective outlets of the spraying apparatus prior to contacting the work piece. In one embodiment, the amount of silver nitrate solution to reducer is from about 47% volume to about 53% volume, i.e., a ratio of silver nitrate solution to reducer (reductant) from about 0.89:1 to about 1.13:1. In another embodiment, the ratio is 1:1. Both the silver nitrate solution and the reducer are in liquid form; hence, these solutions can be spray applied. As discussed above, it is desired that the silver nitrate solution and the reducer not be mixed within the spraying apparatus, but instead be mixed just prior to contact on the substrate surface. The application guns and apparatuses mix the two chemicals externally immediately after each solution leaves the spraying apparatus and just prior to contacting the work piece. Different than other processes for providing a reflective layer on a work piece, Applicant's liquid silver nitrate solution and reducer need not be treated with any form of heat treatment to produce the highly reflective layer. Heat treatment, e.g. exposure over 113° F. (45° C.) would damage the reflective layer at this moment in the process.

At 24, the work piece now including the reflective layer is rinsed with a rinsing agent. Similar to step 18, the rinsing agent can be a de-ionized or distilled water. Spraying the work piece with a rinsing agent having the silver material deposited thereon removes residues from the highly reflective layer and avoids contamination and staining of the highly reflective layer.

As discussed above, different than other processes for applying a highly reflective surface to a work piece, at step 26, the work piece is dried within a temperature range of from about 20° C. (68° F.) to about 45° C. (113° F.). In other words, the work piece is not heated above 80° C. after applying the highly reflective finish to the work piece and prior to applying a later described water-based urethane coating. More particularly, the work piece is not heated above 45° C. after applying the highly reflective finish and prior to the applying a water-based urethane coating. The drying step at 26 can be similar to the drying step described above at step 12.

After excess liquid droplets have been removed from the highly reflective surface on the work piece, at 28 a water-based clear coating is applied on the reflective layer. In one embodiment the water-based clear coating is a water-based urethane coating. This step is different than known electroless plating processes. This water-based clear coating desirably locks, seals and protects the reflective layer thereunder. Different than known electroless plating processes, the water-based urethane coating is applied, e.g., sprayed, onto the reflective layer that has now been deposited on the base coat. The silver reflective layer that is deposited onto the base coat is very thin, e.g., about 1-2 microinches. As discussed above, it is known to apply a solvent-based coating, which for the purposes of this disclosure is a coating where the solvent is an organic based solvent that is not water, directly to the silver reflective layer. Applying the water-based urethane coating on the silver reflective layer advantageously seals the silver reflective layer and allows the finished work piece to sustain much higher temperatures (e.g., about 300° F.) and lower temperatures (e.g., −30° F.) as compared to an electroless silver plating that lacks the water-based urethane coating. Work pieces that only include the solvent-based top coat have the reflective finish begin to disintegrate, deteriorate or degrade at about 200° F. on the higher end and at about −20° F. on the lower end.

The water-based clear coating is applied to the silver reflective layer until the latter is well coated by means of any commonly known spray technique in the art. A single coat or multiples coats of the water-based clear coating can be applied.

At 32, the work piece is dried so that the water-based clear coating can coalesce to form a continuous solid layer. In one embodiment, the water-based clear coat can be force dried with air. The step of force drying with air aims to remove excess moisture from the water-based clear coat on the work piece. The step of force air drying the water-based clear coat can be achieved at room temperature, and more specifically, within a temperature range of about 20° C. (68° F.) to about 25° C. (77° F.). A larger temperature range is allowed. For example the work piece can be baked to dry. In one embodiment a maximum baking temperature is about 200° F. (93° C.).

After the water-based clear coating has dried, a top coat is applied at step 34 or step 36. In one embodiment, the top coat is a solvent-based top coat, where the solvent is an organic based solvent that is not water. The liquid solvent top coat can be sprayed onto and over the water-based clear coating such that the entire surface that is to be coated is evenly coated. The work piece can also be submerged or dipped into the solvent based top coating. The solvent-based top coat in this process can be the same as known solvent-based top coats that have been used previously in electroless silver plating processes.

The liquid solvent-based top coat is next dried at 36 so that the coating coalesces to form a continuous, solid protective top coat. A first method of drying the work piece including the solvent-based top coat is by means of force air drying with air at 38. The force drying step 38 is at room temperature and, more specifically within a temperature range of from about 20° C. (68° F.) to about 25° C. (77° F.).

In another embodiment, the top coat applied to the substrate surface can be a powder-based top coat at 36. A powder-based top coat that can be used with the disclosed process includes ones formed with acrylic resin and polyester resin.

At 39, the work piece can then be baked at about 300° F. It is desirable to keep the baking temperature at this step to less than 350° F. to dry the powder-based top coat.

Figure 2:
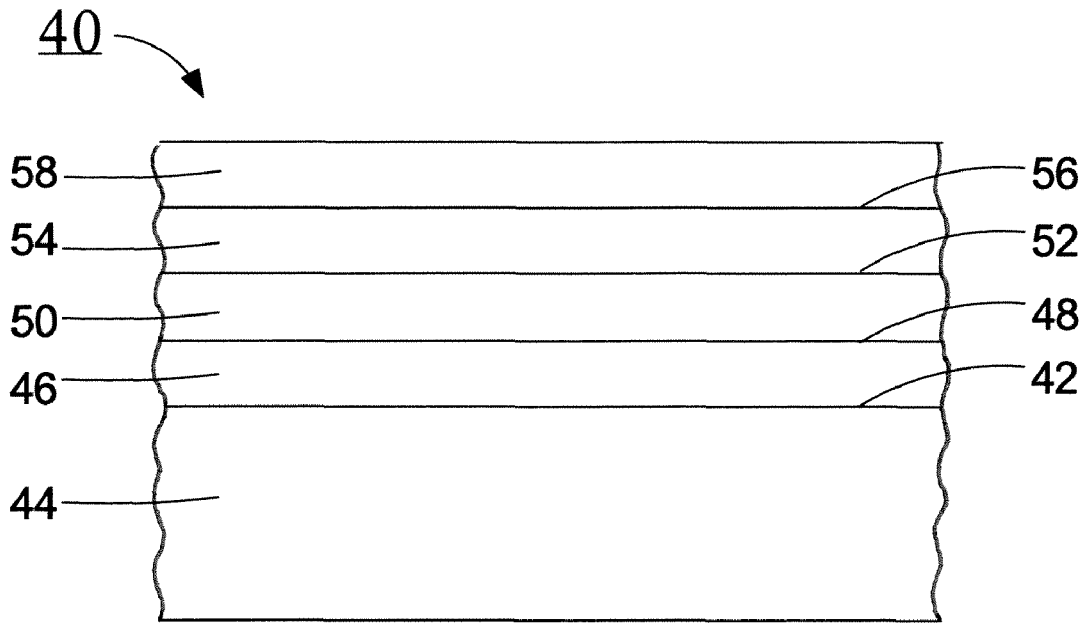
FIG. 2 depicts an article and/or object made by the process of FIG. 1.

Turning to FIG. 2, illustrated is a side view of an article or object 40 formed in accordance with the method described in FIG. 1. An upper (or outer) surface 42 of work piece 44 has a base coat layer 46 applied thereto. In turn an upper (or outer) surface 48 of the base coat layer 46 carries an applied silver reflective layer 50. As further shown in FIG. 2, an upper or outer surface 52 of the silver reflective layer 50 carries an applied water-based coating layer 54, and an upper surface 56 of the water-based coating layer 54 carries an applied top coat layer 58. The applied layers are understood to be formed in accordance with the processing steps as at least set out in the described method.

The work piece 44 may be any of a number of materials including but not limited to wood, plaster, glass, metal, plaster, fiberglass, ceramic, cement or polystyrene. Article or object 40 is intended to represent a section of any of a number of items made from the above materials, including but not limited to, various parts of automobiles, boats, motorcycles, airplanes, jewelry, household appliances, trophies, picture frames, building materials, art work, musical instruments, to name just a few.

It is to be appreciated object 40 is drawn to identify the various layers making up the object, but is not drawn to scale.

The water based coating reduces "creep" in salt spray tests. It also prevents de-lamination of the top coat from the silver that can occur with a solvent based topcoat alone when under rapid temperature changes that might occur for example when a car is washed and then placed outside in sub freezing temperatures.

The exemplary embodiment has been described with reference to the preferred embodiments. Modifications and alterations will occur to those upon reading and understanding the preceding detailed description. It is intended that the exemplary embodiment be construed as including all such modifications and alterations insofar as they come within the scope of the appended claims or the equivalents thereof.

The invention claimed is:

1. A method for electroless silver plating of a work piece comprising:

applying a two-component catalyzed base coat to the work piece;

applying a flame treatment to the work piece;

simultaneously spraying a silver nitrate solution and a reducer on a work piece to form a reflective layer on the work piece;

applying a water-based urethane coating on the reflective layer; and applying either a solvent-based top coat or a powder coat on the water-based urethane coating.

2. The method of claim 1, wherein a ratio of the volume of silver nitrate to the volume of reducer is about 1:1 in the simultaneously spraying step.

3. The method of claim 2, wherein the water-based urethane coating includes a polyurethane resin in a water-based solvent.

4. The method of claim 1, wherein the base coat includes a two-component urethan.

5. The method of claim 1, wherein the base coat includes silicone.

6. The method of claim 1, wherein the work piece is not heated above 80° C. after the spraying step and prior to the applying a water-based urethane coating step.

7. The method of claim 6, wherein the work piece is not heated above 30° C. after the spraying step and prior to the applying a water-based urethane coating step.

8. The method of claim 1, wherein the reflective layer is less than 2 microinches.

* * * * *

UNITED STATES PATENT AND TRADEMARK OFFICE

CERTIFICATE OF CORRECTION

PATENT NO. : 8,187,677 B2
APPLICATION NO. : 12/428984
DATED : May 29, 2012
INVENTOR(S) : Demitrios Roumanis It is certified that error appears in the above-identified patent and that said Letters Patent is hereby corrected as shown below:

Title page, item (12) United States Patent should read as follows:
Roumanis

Title page, item (76) Inventor: should read as follows:
Demitrios Roumanis, Montreal (CA)

Signed and Sealed this
Twenty-eighth Day of August, 2012

David J. Kappos

David J. Kappos
*Director of the United States Patent and Trademark Office*